US006214196B1

(12) United States Patent
Sugiya et al.

(10) Patent No.: US 6,214,196 B1
(45) Date of Patent: Apr. 10, 2001

(54) METHOD OF PRODUCING BISPHOSPHINE OXIDE

(75) Inventors: Masashi Sugiya, Tokyo; Hiroyuki Nohira, Urawa, both of (JP)

(73) Assignee: Nippon Chemical Industrial Co., Ltd., Tokyo (JP)

( * ) Notice: Subject to any disclaimer, the term of this patent is extended or adjusted under 35 U.S.C. 154(b) by 0 days.

(21) Appl. No.: 09/370,167

(22) Filed: Aug. 9, 1999

(51) Int. Cl.[7] ..... C25B 3/10; C25B 3/00

(52) U.S. Cl. ..... 205/416; 205/418; 205/436; 205/437; 205/455; 205/456

(58) Field of Search ..... 205/416, 418, 205/442, 438, 435, 440, 443

(56) References Cited

FOREIGN PATENT DOCUMENTS

447409 * 10/1974 (SU) .

* cited by examiner

*Primary Examiner*—Edna Wong
(74) *Attorney, Agent, or Firm*—Armstrong, Westerman, Hattori, McLeland & Naughton

(57) ABSTRACT

A method of producing a bisphosphine oxide by performing a koble electrolysis coupling reaction to a phosphine oxide carboxylic acid represented by the general formula (1):

(1)

wherein the bisphosphine oxide is represented by the following general formula (2):

(2)

1 Claim, 1 Drawing Sheet

METHOD OF PRODUCING BISPHOSPHINE OXIDE

BACKGROUND OF THE INVENTION

1. Field of the Invention

The present invention relates to a method of producing bisphosphine oxide from phosphine oxide having carboxylic acid group through a Kolbe electrolysis coupling reaction.

2. Description of the Prior Art

In recent years, the ratio of the optically active medicine of all the medicine in the market is increasing year after year. In the last five years, the optically active medicine amounts to 39% of the share. Moreover, the need for optically active substances is not limited to the field of medicine, but extends to fields such as agricultural chemicals, perfume, and even high-performance materials such as ferroelectric liquid crystal and packings for high performance liquid chromatography. One of the methods for synthesizing these optically active compounds is the catalytic asymmetric synthesis. The catalytic asymmetric synthesis method is considered as an excellent method for economically obtaining large amounts of pure optically active compound from prochiral compound. Numerous development of asymmetric catalyst has been conducted in the last 20 years. Especially, rhodium and ruthenium complex having optically active phosphine as a ligand has been studied.

Of the compounds having optically active phosphine as a ligand as mentioned above, a bisphosphine compound having a wide accommodation range of reaction temperature, and especially having high asymmetry recognition ability under high temperature and high pressure is preferred. This optically active bisphosphine compound may be obtained by reducing bisphosphine oxide while maintaining its asymmetry using hexachlorodisilane. (K. Naumann, G. Zon, and K. Mislow, J. Am. Chem. Soc., 91, 7012 (1969)).

Of the methods of producing optically active bisphosphine oxide, the most common method known is to perform an oxidation coupling of the optically active phosphine oxide having methyl group with an organolithium compound such as LDA (lithium diisopropylamide) and copper compound such as copper chloride. (B. D. Vineyard, w. S. Knowles, M. J. Sabacky, G. L. Backman and O. J. Weinkauff, J. Am. Chem. Soc., 99, 5946 (1977)).

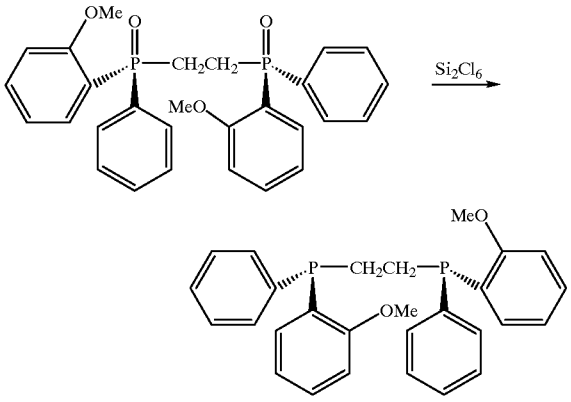

-continued

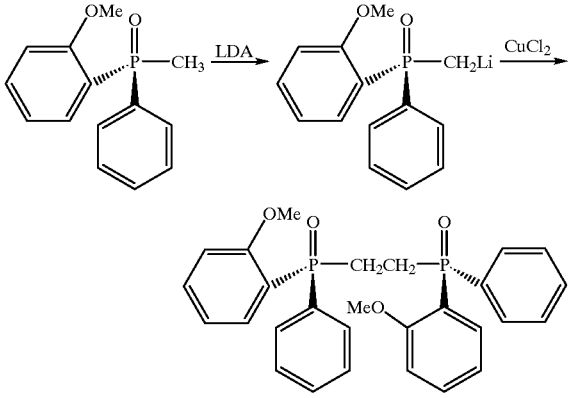

However, the organolithium compound used in these methods is very active to air, water and the like, so not only it is difficult to industrialize, but it is also difficult to perform economically since it concerns the separation of by-products of metal impurity such as copper salt and the like.

SUMMARY OF THE INVENTION

Through continuous studies concerning new methods of producing bisphosphine oxide which overcome the above-mentioned problems, the present inventors discovered and completed a method of using phosphine oxide having carboxylic acid group as the material in producing a bisphosphine oxide through Kolbe electrolysis coupling reaction.

The method according to the present invention is a novel production method, and with a compound having its asymmetric center on the phosphorus atom of the phosphine oxide having carboxylic acid group as the material, asymmetry is maintained even in the intermediately produced radical, and asymmetry is also maintained in the produced bisphosphine oxide.

Accordingly, the present invention provides a method of producing a bisphosphine oxide characterized by performing a Kolbe electrolysis coupling reaction to a phosphine oxide carboxylic acid shown by the following general formula (1):

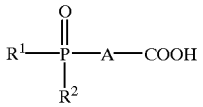

(1)

(in the formula, $R^1$ and $R^2$ represent a linear or branched alkyl group, hydroxyalkyl group, or aminoalkyl group with 1–18 carbons, or a substituted or non-substituted phenyl group, wherein $R^1$ and $R^2$ may either be identical or dissimilar, and A represents a linear or branched alkylene group), wherein said bisphosphine oxide is shown by the following general formula (2):

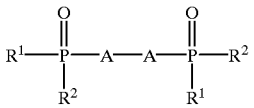

(2)

(in the formula, $R^1$, $R^2$ and A represent what are defined above).

Said bisphosphine oxide is a useful compound as a precursor of an optically active bisphosphine compound which is useful as a ligand of an asymmetric synthesis catalyst.

PREFERRED EMBODIMENT OF THE INVENTION

Figure 1:
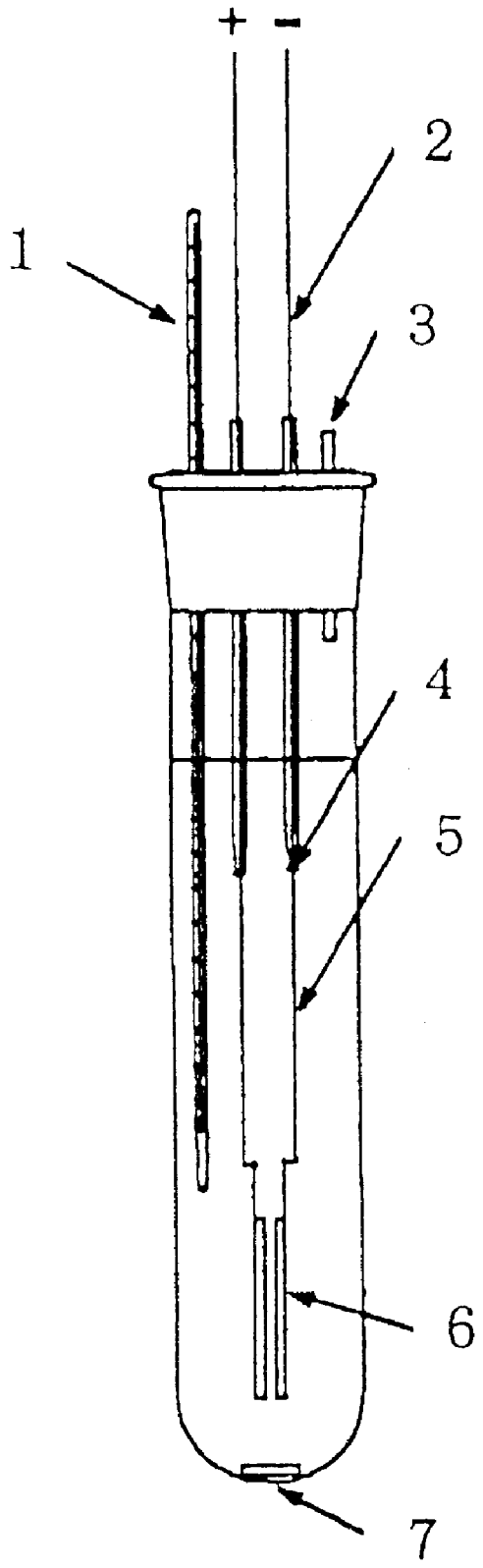
FIG. 1 is a schematic view of an electrolysis reactor used in example 1 of the present invention.

The present invention will now be explained in detail.

The production method according to the present invention involves performing a Kolbe electrolysis coupling reaction to a phosphine oxide carboxylic acid, and the starting material, which is a phosphine oxide carboxylic acid, is shown by a general formula (1).

(Starting Material)

In a phosphine oxide having a carboxylic acid group shown by the general formula (1), the letter A in the formula may be a linear or branched alkylene group such as a methylene group, ethylene group, trimethylene group, tetramethylene group and the like, and preferably represents a linear alkylene group with 1–4 carbons. Also, $R^1$ and $R^2$ are not limited, but represent a linear or branched alkyl group, hydroxyalkyl group, or aminoalkyl group with 1–18 carbons, or substituted or non-substituted phenyl group. $R^1$ and $R^2$ may either be identical or dissimilar, but in the case of an optically active substrate having its optical activity center on a phosphorus atom, $R^1$ and $R^2$ differ from each other and have an angle of rotation.

In obtaining an optically active phosphine oxide with a carboxylic acid group, the following methods are known; (1) an optical resolution method of a racemic modification, (2) a method using biological chemistry means, (3) a method of performing an asymmetric synthesis, and (4) a method of chemically transforming an optically active substance existing in nature. The method is not limited as long as it is industrially obtainable.

(Electrolysis Condition)

The present invention is realized by performing a Kolbe electrolysis coupling to the above-mentioned starting material, and a solvent is used in performing electrolysis. The solvent used for the electrolysis is methanol and hydrous methanol, and the water content should be 4% or less since the yield of the reaction product decreases. Also, it is not preferable to use an aqueous solution or adipolar aprotic solvent, since abnormal Kolbe reaction products such as olef in and alcohol (Hosfer-Moest Reaction) are produced as by-products from the starting material.

The pH of the electrolysis solution is preferably neutral or weak acid. Also, in order to stabilize electricity, a supporting salt may be added according to need. As the supporting salt, sodium salt such as sodium perchlorate and sodium methylate, and lithium salt such as lithium perchlorate are preferred. The supporting salt should not be used unless it is necessary since the yield of the object bisphosphine oxide decreases as the amount of the supporting salt increases. Therefore, when using the supporting salt, the amount should be limited to 5 wt % per 1 weight of material or less.

As the electrode used herein, it is preferable to use a platinum electrode and carry out electrolysis with high current density in order to improve radical development concentration per unit area of the electrode. Industrially, an electrode of platinum-plated titanium plate could also be used. In order to substitute the platinum electrode, an electrode of iridium, gold, palladium or lead dioxide may be used.

When electrolysis volume increases, the temperature of the electrolysis solvent rises, so it is preferable to maintain the temperature by soaking in water bath. The electrolysis temperature is preferred to be relatively low, specifically between 0 to 20° C. Also, it is preferable to stir the solvent in order to maintain a uniform temperature.

The electrolysis is normally a controlled current electrolysis, and the current volume is 0.1 to 3 A, preferably between 0.5 to 2 A. The distances between the electrodes is normally set to 1 to 5 mm, so that a current density of 10 to 100 $mA/cm^2$ may be obtained.

The electrified time differs according to the starting material or electrolysis condition, but it is normally between 0.5 to 36 hours, preferably about 1 to 10 hours.

A racemic modification and an optically active substance may be obtained from the bisphosphine oxide obtained by the above-mentioned method of the present invention. For example, (+)-(S,S)-1,2-ethanediylbis ((1,1,3,3-tetramethylbutyl) methylphosphine oxide), (−)-(R,R)-1,2-ethanediylbis ((1,1,3,3-tetramethylbutyl) methylphosphine oxide), (+)-(S,S)-1,4-butanediylbis ((1,1,3,3-tetramethylbutyl) methylphosphine oxide), (−)-(R,R)-1,4-butanediylbis (1,1,3,3-tetramethylbutyl) methylphosphine oxide), (+)-(S,S)-1,2-ethanediylbis ((1,1,3,3-tetramethylbutyl) ethylphosphine oxide, (−)-(R,R)-1,2-ethanediylbis ((1,1,3,3-tetramethylbutyl) ethylphosphine oxide, (+)-(S,S)-1,2-ethanediylbis ((1,1,3,3-tetramethylbutyl) tert-butylphosphine oxide, (−)-(R,R)-1,2-ethanediylbis ((1,1,3,3-tetramethylbutyl) tert-butylphosphine oxide, (+)-(S,S)-1,2-ethanediylbis ((o-methoxyphenyl) phenylphosphine oxide), (−)-(R,R)-1,2-ethanediylbis ((o-methoxyphenyl) phenylphosphine oxide), (+)-(S,S)-1,2-ethanediylbis ((o-ethylphenyl) phenylphosphine oxide), (−)-(R,R)-1,2-ethanediylbis ((o-ethylphenyl) phenylphosphine oxide), 1,2-ethanediylbis (1,1,3,3-tetramethylbutyl) methylphosphine oxide), 1,4-butanediylbis ((1,1,3,3-tetramethylbutyl) methylphosphine oxide), 1,2-ethanediylbis (1,1,3,3-tetramethylbutyl) ethylphosphine oxide), 1,2-ethanediylbis ((1,1,3,3-tetramethylbutyl) tert-butylphosphine oxide), 1,2-ethanediylbis ((o-methoxyphenyl) phenylphosphine oxide), 1,2-ethanediylbis ((o-ethylphenyl) phenylphosphine oxide) and the like could be obtained.

The present invention will now be explained in detail according to the examples.

EXAMPLE 1

In a cylindrical glass container with a capacity of 50 ml as shown in FIG. 1, 4.68 g of (carboxymethyl) (1,1,3,3-tetramethylbutyl) methylphosphine oxide (0.02 mol) is dissolved in 50 ml of methanol, and 0.02 g of sodium methoxide is added as an electrolyte. Platinum electrodes (2 cm×4 cm×1 mm) are provided with 1 mm distances between the electrodes, and direct current controlled current electrolysis is carried out at 0.7 amperes. At the same time as the electrolysis, large amounts of bubbles were generated, and rising of liquid temperature was observed. In order to maintain liquid to approximately the same temperature, it is cooled with iced water, and mixed to maintain a uniform temperature. After providing electricity for 7 hours, the reaction liquid is analyzed by high performance liquid chromatography. The material was decreased by 92.7%.

The solvent is removed using evaporator, and then dissolved in 100 ml of dichloromethane, and the unreacted material is extracted with 1-N-sodium hydroxide aqueous solution. The organic layer is washed with high purity water. After dehydrating for a day with sodium nitric anhydride, the solvent is removed by the evaporator, so as to obtain 2.50 g of white crystal. The crystal is then recrystallized and purified with acetone, and 0.83 g of white crystal having a melting point of 199 to 200° C. were obtained.

The result of the analysis by NMR is as mentioned below, and the composition is 1,2-ethanediylbis ((1,1,3,3-tetramethylbutyl) methylphosphine oxide).

FAB-MS(Pos.); 379[M+H]+ $^1$H-NMR(ppm, $CDCl_3$); 1.06(s, 18H, $CH_3$), 1.32–1.41 (m, 18H, $CH_3$, P-$CH_3$), 1.47–1.61 (m, 4H, $CH_2$), 1.83–2.02 (m, 4H, —$CH_2$—$CH_2$—)

EXAMPLE 2

In a cylindrical glass container with a capacity of 50 ml as used in Example 1, 0.95 g of (−)-(S)-[(carboxymethyl) (1,1,3,3-tetramethylbutyl) methylphosphine oxide (0.004 mol) having anangleofrotationof [α] 25 D=−15.8 (c 1.94, $ChCl_3$), an optical purity of (HPLC)=98.6% e.e. and a melting point of 99 to 100° C., is dissolved in 30 ml of methanol, and 0.02 g of sodium methoxide is added as an electrolyte. Platinum electrodes (2 cm×4 cm×1 mm) are provided with 1 mm distances between the electrodes, and direct current controlled current electrolysis is carried out at 0.7 amperes. In order to maintain the liquid at approximately the same temperature, it is cooled with iced water, and mixed so as to keep the temperature uniform. After providing electricity for 3 hours, the reaction liquid is analyzed by high performance liquid chromatography. The material was decreased by 98.7%.

The solvent is removed using the evaporator, and then dissolved in 100 ml of dichloromethane, and the unreacted material is extracted with 1-N-sodium hydroxide aqueous solution. The organic layer is washed with high purity water. After dehydrating for a day with sodium nitric anhydride, the solvent is removed by the evaporator, so as to obtain 0.54 g of white crystal. The crystal is then recrystallized and purified with acetone, and 0.27 g of white crystal having a melting point of 118 to 119° C. were obtained.

The product was (+)-(S,S)-1,2-ethanediylbis ((1,1,3,3-tetramethylbutyl) methylphosphine oxide having an angle of rotation of [α] 25 D=+13.4 (c 1.04, $CHCl_3$).

The result of the analysis by NMR is as mentioned below.

FAB-MS(Pos.); 379[M+H]+ $^1$H-NMR(ppm, $CDCl_3$); 1.06(s, 18H, $CH_3$), 1.31–1.41 (m, 18H, $CH_3$, P-$CH_3$), 1.49–1.62 (m, 4H, $CH_2$), 1.70–1.81 (m, 2H, —CH—CH—), 2.17–2.29 (m, 2H, —CH—CH—)

The present invention having the above-mentioned composition could produce a bisphosphine oxide with good yield from phosphine oxide using Kolbe electrolysis coupling reaction, which is useful as a precursor of an optically active bisphosphine which may be used as a ligand for an asymmetric catalyst.

We claim:

1. A method of producing a bisphosphine oxide characterized by performing a Kolbe electrolysis coupling reaction to a phosphine oxide carboxylic acid shown by the following general formula (1):

(1)

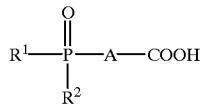

in the formula, $R^1$ and $R^2$ represent a linear or branched alkyl group, hydroxyalkyl group, or aminoalkyl group with 1–18 carbons, or a substituted or non-substituted phenyl group, wherein $R^1$ and $R^2$ may either be identical or dissimilar, and A represents a linear or branched alkylene group, wherein said bisphosphine oxide is shown by the following general formula (2):

(2)

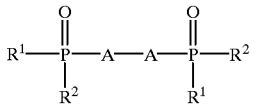

in the formula, $R^1$, R2 and A represent what are defined above.

* * * * *